United States Patent [19]

Kiamco et al.

[11] Patent Number: 4,537,390

[45] Date of Patent: Aug. 27, 1985

[54] HIGH SPEED FOLDER FLY

[75] Inventors: Roberto C. Kiamco, Wood Dale; Eugene Skipor, Jr., Palos Hills, both of Ill.

[73] Assignee: Rockwell International Corporation, Pittsburgh, Pa.

[21] Appl. No.: 620,649

[22] Filed: Jun. 14, 1984

[51] Int. Cl.[3] ..... B42B 1/02

[52] U.S. Cl. ..... 270/53; 270/60; 271/187; 271/315

[58] Field of Search ..... 270/47–49, 270/60, 13, 19; 271/314–315, 72, 82, 83, 109, 122, 123, 187; 198/644

[56] References Cited

U.S. PATENT DOCUMENTS

| | | | |
|---|---|---|---|
| 3,567,005 | 3/1971 | Johnson | 271/72 |
| 4,132,403 | 1/1979 | Weisbach et al. | 271/82 X |
| 4,244,565 | 1/1981 | Geier | 271/187 X |
| 4,357,008 | 11/1982 | Campbell | 271/187 |
| 4,473,219 | 9/1984 | Ichikawa | 270/60 X |

*Primary Examiner*—E. H. Eickholt

[57] ABSTRACT

A rotary fly conveyor for use with the folders of newspaper printing presses which comprises a fly hub, generally curved fly fingers extending outwardly from the hub to form pockets for receiving newspapers and a gripping means located within each of the pockets to slow the speed of travel of the newspapers into the pockets and to hold them firmly in the pocket until removed at a discharge station.

6 Claims, 2 Drawing Figures

HIGH SPEED FOLDER FLY

BACKGROUND OF THE INVENTION

The production of newspapers generally comprises the steps of printing the paper, slitting, longitudinally folding the paper, effecting a transverse fold in either a rotary or jaw folder and then depositing the folded papers on a belt conveyor in imbricated form by means of a rotary fly conveyor, or fan for transport to the mail room. As the operating speeds of modern day presses are quite high it is not unusual to have newspapers exiting from the folder at speeds up to 2300 fpm. The fans or folder flys which have outwardly extending usually arcuately shaped fingers attached to a central hub, define pockets into which the newspapers are received for delivery to the usual belt conveyor that is located beneath the fly. Because of the high rates of travel of the newspapers they tend to strike the bottoms of the pockets and bounce; an occurrence which is undesirable because, among other things, the newspapers are laid unevenly spaced on the receiving conveyor.

It is therefore a primary object of this invention to provide an improved newspaper rotary fly conveyor which insures uniform laydown of the papers on a receiving conveyor.

It is an additional object of this invention to provide an improved newspaper fly conveyor in which means is provided to slow down the entry of the newspapers into the receiving pockets of the fly.

It is a further object of this invention to provide an improved newspaper fly conveyor wherein gripping means is provided in each newspaper receiving pocket on the fly to hold the newspapers against bouncing when arriving at the bottom of the pockets.

Yet another object of this invention is to provide an improved newspaper rotary fly conveyor having spring biased grippers in the newspaper receiving pockets.

A still further object of this invention is to provide an improved newspaper fly conveyor in which positive stripping means is provided to remove newspapers from the pockets of the rotary fly.

Figure 1:
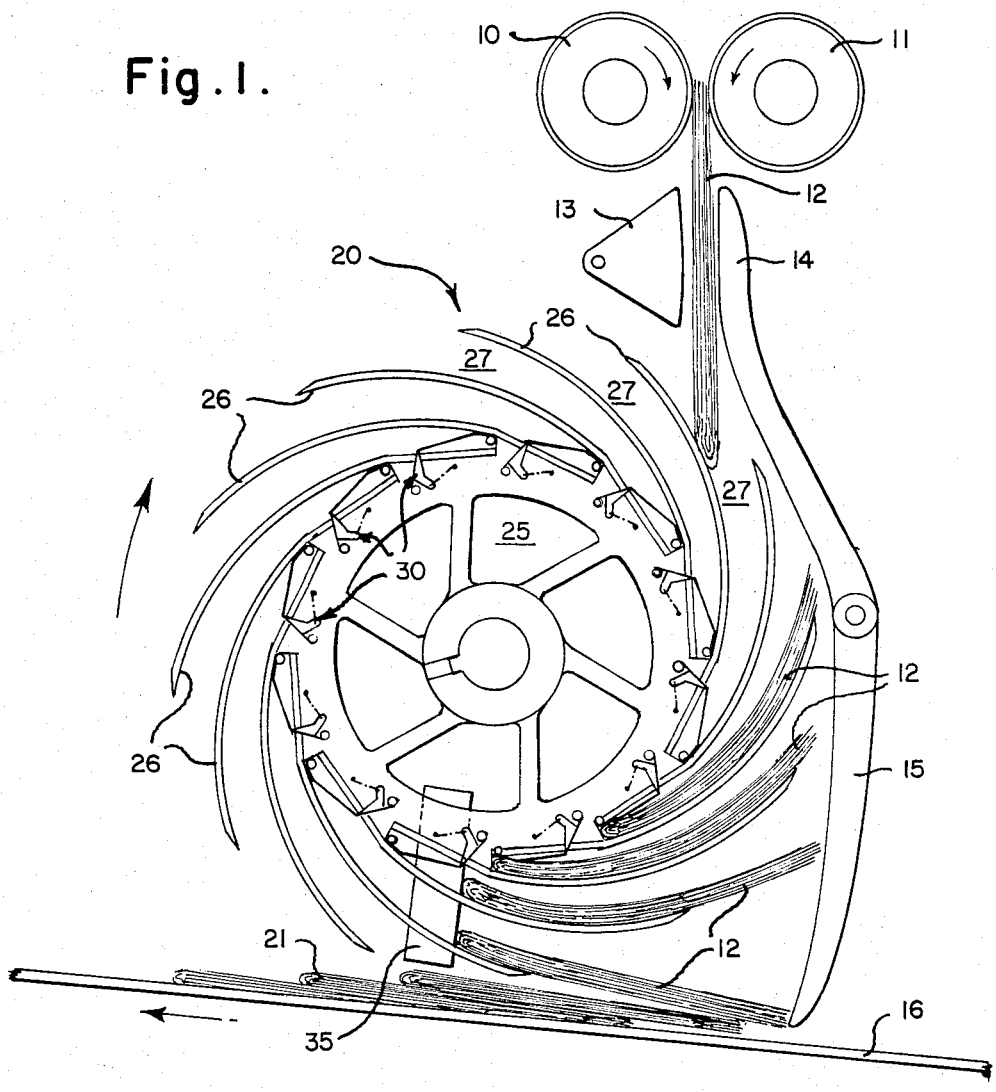
Figure 2:
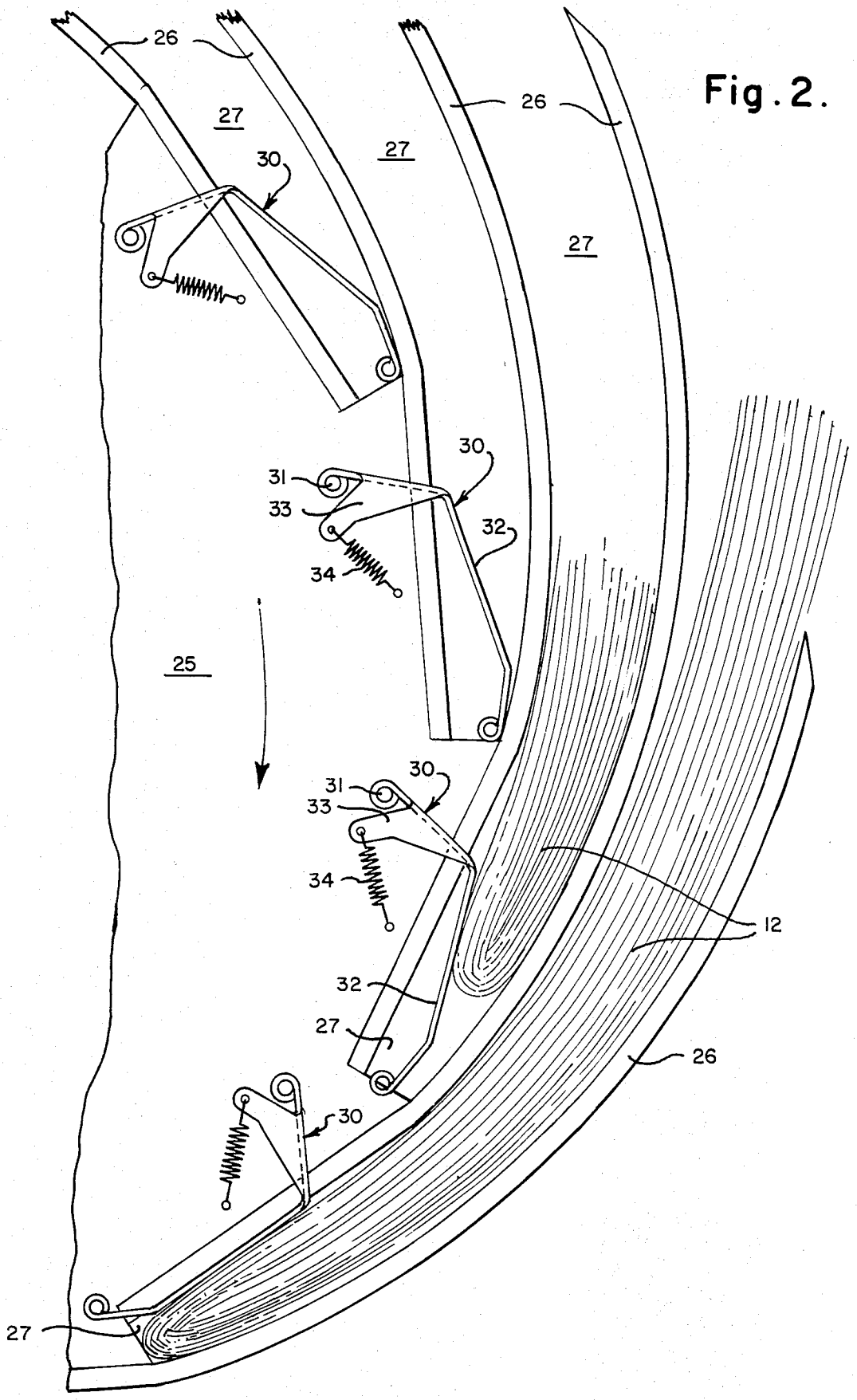

Other objects and advantages of this invention will be in part obvious and in part explained by reference to the accompanying specifications and drawings in which:

FIG. 1 is an end elevation of the rotary fly of this invention and also shows the fold rolls and normal conveyor that receives newspapers from the fly; and FIG. 2 is an enlargement of a segment broken from the fly of FIG. 1 to show the newspaper retaining means located in the newspaper receiving pockets.

DESCRIPTION OF THE INVENTION

For a better understanding of the nature of the present invention, reference is made to the drawings and particularly to FIG. 1 which is illustrative of both the improved fly conveyor and the associated devices between which the fly operates. In FIG. 1 numerals 10 and 11 indicate the fold rollers between which a signature copy or newspaper 12 passes as it is given its final, transverse fold. Immediately beneath rolls 10 and 11 are guide elements which assist the newspaper 12 in properly advancing to the fly conveyor that is located beneath the guide elements. The left hand guide element 13 restrains newspaper 12 from falling to the left while the right hand upper guide element 14 and lower guide element 14 (sometimes referred to as shoes) control the tail of the newspapers as they move downwardly toward the usual belt type conveyor designated by numeral 16.

Numeral 20 indicates the general improved fly conveyor of this invention. The purpose of the fly conveyor is to take newspapers as they move between guide elements 13 and 14 and carry them directly down to the conveyor belt 16 as they are formed into an imbricated stream as designated at 21. The fly 20 is comprised of a central fly hub 25 and a plurality of fly fingers 26 that are attached to and extend outwardly from hub 25 in a generally curved or arcuate form. The fingers 26 are usually made up of fairly narrow bands of steel or other suitable rigid material so that a plurality of such bands would exist in any given row across the width of the fly. The overlapping manner in which fingers 26 are secured to hub 25 results in the formation of pockets 27 into which newspapers are received as shown in FIG. 1.

As stated earlier in the description, the speed of modern web-fed presses is such that newspapers exit from the folder mechanism at speeds approaching 2300 feet per minute, and presently improvements and modifications are continually resulting in even yet higher speeds. A problem that has arisen as a result of such high speeds is that of having the newspapers bounce when the folded edge arrives at the bottom of the pocket into which the paper is inserted for transport to the lower conveyor.

The present invention makes it possible to accommodate higher speeds while eliminating the difficulties that arise when newspapers are free to bounce away from the bottom wall of the receiving pocket. This mechanism is best shown in FIG. 2 where signature copies 12 are shown in two different positions. The first position being that in which the newspaper is not fully received into the pocket 27 and the second or lowermost position being that wherein the copy has been received into the pocket.

In order to overcome the stated problem applicant has included means that is operatively located in each pocket to slow the rate of travel of the newspaper as it approaches the bottom of the pocket. Specifically, this means takes the form of a lever arm 30 that is pivotally connected to hub 25 at axis 31. The lever extends outwardly from pivot 32 into the pocket 27 and then extends downwardly at an angle, as indicated at 32, toward the bottom of the pocket. The upper extension of lever 30 contains an arm 33 that receives one end of a tension spring 34 the other end of the spring being attached to hub 25. With this construction it is obvious that as a newspaper 12 enters into the pocket 27 the folded edge strikes the angle portion 32 of lever 30 and causes it to pivot inwardly until it finally assumes the position shown where the newspaper 12 is fully inserted into the pocket. As the newspaper travels against lever 30 it meets increasing resistance from spring 34 so that by the time insertion is complete the newspaper is firmly gripped and no bounce back can occur. It should be pointed out that the type of spring and lever construction shown is not limiting since a coil spring could be used in place of the tension spring, for example, or any other form of bias means could be used which would insure proper gripping of the signature in position.

Referring once again to FIG. 1 of the drawings, there is provided a stripper bar 35 that is fixedly mounted as part of the fly conveyor and which extends upwardly between fingers 26. Thus as each newspaper is delivered within its pocket 27 the folded edge ultimately is met by stripper 35 and as the fingers continue their rotary travel the newspaper is removed from its pocket and deposited as part of the imbricated stream on belt 16. By eliminating bouncing of the newspapers within the pockets it is assured that each newspaper will be fully inserted and therefore that the resulting stream on conveyor 16 is composed of newspaper signatures that are uniformly and evenly spaced with respect to each other.

Although the present invention has been described in connection with a preferred embodiment many variations and modifications will become apparent to those skilled in the art. It is, therefore, that the present invention be limited not by the specification disclosure herein but only by the appended claims.

What is claimed is:

1. A high speed rotary fly for receiving newspapers from a folder and despositing them in imbricated form on a conveyor apparatus, said fly comprising:

(a) a central fly hub;

(b) a plurality of fly fingers attached to said fly hub and extending outwardly therefrom in arcuate, overlapping relationship to form pockets into which newspapers are received; and (c) yieldable means pivotally attached to said fly hub extending across the bottom portion of each pocket to prevent the newspaper from bouncing when it reaches the pocket bottom.

2. A high speed rotary fly as defined in claim 1 wherein said means operatively located in each pocket is configured to slow the rate of travel of the newspaper as it approaches the bottom of the pocket.

3. A high speed rotary fly as defined in claim 2 wherein said means operatively located in each pocket includes a lever arm that is attached to said hub and extends outwardly into the pocket and downwardly to the bottom of the pocket.

4. A high speed rotary fly as defined in claim 3 wherein said lever arm is pivotally mounted on said fly hub on one end and biasing means is provided to urge the other end of said lever away from said hub.

5. A high speed rotary as defined in claim 4 wherein said biasing means is a spring.

6. A high speed rotary fly as defined in claim 1 wherein stationary stripper means is provided at the location where newspapers are deposited on the conveyor apparatus said stripper means extending into the pockets between said fly fingers to remove the papers from the pockets.

* * * * *